US005671479A

United States Patent [19]

Dedrick

[11] Patent Number: 5,671,479

[45] Date of Patent: Sep. 30, 1997

[54] REVERSIBLY COLLAPSIBLE LAP TRAY

[76] Inventor: Ted Randall Dedrick, 14135 Campo Rd., Jamul, Calif. 92035

[21] Appl. No.: 432,526

[22] Filed: May 1, 1995

[51] Int. Cl.[6] ..... A41D 13/04; A41D 27/00; A41D 27/06

[52] U.S. Cl. ..... 2/46; 2/48; 2/49.1; 2/51; 2/52; 2/255; 2/259

[58] Field of Search ..... 2/46, 47, 48, 49.1, 2/49.2, 49.3, 49.4, 49.5, 50, 51, 52, 255, 256, 257, 259, 260, 260.1, 261, 262, 263, 264, 271

[56] References Cited

U.S. PATENT DOCUMENTS

| | | | |
|---|---|---|---|
| 277,178 | 5/1883 | Webb | 2/51 |
| 615,293 | 12/1898 | Maier . | |
| 677,010 | 6/1901 | Ziller | 2/49.2 |
| 1,108,557 | 8/1914 | Dudley . | |
| 2,091,083 | 8/1937 | Polikoff | 2/49.1 |
| 2,532,932 | 12/1950 | Neiswander . | |
| 2,643,384 | 6/1953 | Thompson . | |
| 2,648,845 | 8/1953 | Berman | 2/48 |
| 2,672,614 | 3/1954 | Zimmerman et al. | 2/49.3 |
| 2,697,222 | 12/1954 | Reid . | |
| 2,738,511 | 3/1956 | Brady . | |
| 3,210,773 | 10/1965 | Lewis | 2/48 |
| 3,407,407 | 10/1968 | Hollander et al. . | |
| 4,114,199 | 9/1978 | Malan . | |
| 4,215,432 | 8/1980 | Smith | 2/48 |
| 4,660,224 | 4/1987 | Ashcraft | 2/48 |
| 4,815,784 | 3/1989 | Zheng . | |
| 4,946,094 | 8/1990 | Stang . | |
| 5,056,159 | 10/1991 | Zemke, Jr. . | |
| 5,062,558 | 11/1991 | Stang . | |
| 5,075,897 | 12/1991 | Daniels | 2/49.4 |

FOREIGN PATENT DOCUMENTS

| | | | |
|---|---|---|---|
| 30834 | 1/1932 | Australia | 2/52 |
| 908598 | 10/1962 | United Kingdom | 2/52 |

*Primary Examiner*—Jeanette E. Chapman
*Attorney, Agent, or Firm*—Knobbe, Martens, Olson & Bear

[57] ABSTRACT

The foldable lap tray [12] of the invention includes a flat web [11] to cover the wearer's lap, a foldable bib [13] attached to the lap tray, and a loop of spring material [10] that holds the web taut when the spring is fully extended. The bib is reversibly connected to the user's neck by a circular strap [16] or other well known means of attachment, preferably with a slidable closure element [17]. The lap tray is foldable by collapsing the spring into an odd-numbered series of smaller connected loops. In one embodiment, the lap tray has one side that is relatively concave [18] so that the tray accommodates the contour of the user's body when placed on the lap.

21 Claims, 5 Drawing Sheets

REVERSIBLY COLLAPSIBLE LAP TRAY

FIELD OF THE INVENTION

The present invention relates to a tray to cover a lap, and specifically relates to a collapsible tray of flexible material with a spring support that can be reversibly folded simply by twisting it. The tray may have an attached bib.

BACKGROUND OF THE INVENTION

Trays have long been used by people as portable surfaces to hold objects or serve as a surface on which to work, play, or eat. Bibs have long been used to protect people, especially infants and invalids, from spilled food and liquids. Bibs have been modified to make them more efficient at catching spills such as by including pockets, attaching the bib to a table or a tray of an infant's chair, or attaching a tray to the bib.

Prior art modified bibs that have pockets include, for example, a bib disclosed in U.S. Pat. No. 615,293 in which the lower edge forms a pocket when drawcords on the sides are fastened appropriately. U.S. Pat. No. 2,532,932 discloses an infant's bib in which the lower edge attaches to the infants chair to form a pocket and tray cover. U.S. Pat. No. 2,738,511 similarly claims a bib which covers a tray on an infant's chair and a means of attaching a bowl to the tray cover. U.S. Pat. No. 2,697,222 discloses a bib in which the side and lower edges are gathered to form a seamless pocket. U.S. Pat. No. 2,643,384 discloses a bib in which the lower edge is turned upward to form a pocket which is attached by suction cups to a surface on an infant's chair. U.S. Pat. No. 3,407,407 discloses a bib with an attached pocket that is held open by a frame.

Prior art bibs have also been modified to include tray-like elements. U.S. Pat. No. 1,108,557 discloses a bib with an integrally attached lap-covering portion held at right angles to the bib portion by triangular side pieces. U.S. Pat. No. 2,672,614 discloses a bib with an integrally attached tray having a stiff upwardly-extending edge. U.S. Pat. No. 4,114,199 claims an infant's bib-tray in which the stiff integral tray with upwardly folded edges is attached to the bib by accordion folds to allow extension of the bib to fit different sized users. U.K. Pat. No. 1,008 discloses a bib in which the lower portion has a stiff raised edge and is placed on the table to form a tray on which the child's plate is placed. The tray and bib system disclosed in U.S. Pat. No. 5,062,558 is a bib with an integral collapsible housing for holding a tray with corner posts. The inserted tray supports the cavity of the tray housing that has raised sides connected to the bib by angular side pieces. U.S. Pat. No. 4,946,094 discloses a box-like container system with internal compartments and a cover, wherein the system is attached to the user by an adjustable strap. The bib-tray disclosed in U.S. Pat. No. 5,056,159 comprises a disposable flexible tray and an attached bib with a collar that fits around the user's neck. The tray is a sealed cavity formed from a bottom sheet, sides and a top sheet from which the bib is formed by tearing perforations in the top sheet and lifting the bib portion up. Similarly, perforations are torn to create the neckhole and collar. The flexible bib-trays can be stored on a roll from which end-to-end connected bib-trays are dispensed.

As people spend greater amounts of time in travel, especially in automobiles, they often consume food in their cars. Because of the potential for spills while consuming food in a car, there is a need for bibs and trays for both children and adults. A tray can serve as a surface on which to conveniently place solid foods or containers and both a bib and tray can protect the wearer from spills.

While traveling, children often become bored unless they can play a game that is appropriate to the confines of a small area such as a car or an airline seat. A bib-tray worn by a child while traveling may provide a surface on which the child can play. Indeed, the surface of the tray itself may become part of the child's play if indicia are imprinted on it. Objects such as small toys or game pieces can be placed on the tray using the indicia in an appropriate manner.

Because such trays or bib-trays would generally be used temporarily while traveling, or while sitting a car or similar confined space, it is important that the tray or bib-tray be easily stored when not in use. Thus there is a need for a collapsible bib-tray or tray.

Flexible spring materials can be formed into loops that are circular. Such circular loops can be twisted out of the plane of the single loop to collapse and fold the loop into a series of odd-numbered connected smaller loops. Folding produces a smaller multi-looped configuration relative to the plane of the extended loop (as illustrated in FIG. 13 of U.S. Pat. No. 4,815,784). The loop can be restored to its open single-loop configuration simply by twisting the spring in the opposite direction.

Recently, flexible circular loops covered with fabric have been used to make a cloth hat sold in the Orient and an automobile sunshield. The latter, disclosed in U.S. Pat. No. 4,815,784, comprises a pair of flexible circular loops, each covered with fabric, joined together with a fabric hinge to produce a broad elliptical shaped shield when opened.

All of the prior art modified bibs that include integral trays formed from the lower portion of the bib have stiff supports to maintain the shape in the tray. None of the prior art bib-trays are reversibly collapsible into a smaller configuration of connected loops. Furthermore, although some prior art bibs include stiff supports such as plastic frames, steel wire, whalebone, cane, woven horse-hair, buckram cord, India rubber or the like, none uses a spring element to support the edge of the tray. Finally, most of the prior art bib-trays have upwardly-extending sides on the trays, unlike the relatively smooth edge of the disclosed invention.

SUMMARY OF THE INVENTION

The collapsible tray of the present invention can be conveniently folded into a smaller size merely by twisting the tray into a smaller multi-looped configuration. When a bib of flexible material is attached to the tray, the bib is folded onto the tray before it is twisted so that both the bib and tray are collapsed simultaneously into the folded multi-looped configuration. The folded tray may be stored in its closed configuration, either alone or after inserting it into a pouch or similar container. A container helps maintain the folded configuration and protects the tray or bib-tray when it is not in use. Because of the relatively small size and light weight of the folded tray or bib-tray, it can be stored easily in a purse, backpack, car glove box, luggage or the like for convenient recovery when it is needed.

In the present invention, a collapsible lap tray includes a spring material in the periphery of a tray made of a flexible material, which may have an attached bib. The tray is collapsible by twisting the periphery of the tray to form an odd number of turns in the folded spring. In this relatively small configuration, the collapsible tray, with or without an attached bib, is easily stored. When needed, it can be restored to its open configuration by twisting it in the direction opposite of that used to collapse the loop.

In some situations, a tray without a bib would be preferred. For example, a collapsible tray may be taken to a sporting event where the user would place it on his lap while eating but store it folded when it is not in use. For an additional use, appropriate colors or team logos could be incorporated into the collapsible tray so that the user could hold it up as a sign while cheering or jeering at the event. When a tray without a bib is used, its shape includes a relatively concave side so that it accommodates the user's body, thus making it easier to hold on the lap.

According to the invention, there is provided a foldable lap tray including a flexible web of sufficient size to cover the lap of a wearer, and the web defines a plane when in an opened configuration. The foldable lap tray also includes an elongated spring material in the form of a loop attached to the periphery of the flexible web and adapted to fold into a smaller multi-looped folded configuration upon twisting the spring material out of the plane of the web. The foldable lap tray also includes a foldable bib connected to the flexible web and a means to attach the bib around the neck of a wearer. In one preferred embodiment, the spring material is a flattened material having in cross section a major dimension and a minor dimension, wherein the major dimension of the spring material is generally orthogonal to the plane of the web. In another preferred embodiment, the spring applies outward tension around the entire periphery of the web to hold the web in a flat open configuration, where the shape of the web defines the spring's opened configuration. There is also provided a fabric tape that encircles the spring and attaches the spring to the web. In one preferred embodiment, the web is fabric, either woven or nonwoven. Preferably, the fabric is liquid repellant. In preferred embodiments, the bib is attached around the neck of a wearer by ties or a circular strap defining an opening through which the neck is inserted. Preferably, there is included a slidable closure element on the bib to adjust the size of the opening defined by the circular strap. The spring of the tray can be made of metal, a polymer material, or a composite material. In a preferred embodiment, the shape of the tray is substantially rectangular. The tray can have at least one side that extends in a concave manner inward toward the center of the tray to allow the tray to accommodate the contour of the wearer's body. There is preferably at least one pocket attached to the tray. In another preferred embodiment, the tray includes indicia on at least one surface of the web.

According to another aspect of the invention, there is provided a foldable lap tray including a flexible web of sufficient size to cover the lap of a wearer, wherein the web defines a plane when in an opened configuration, and the web has at its periphery first, second, third, and fourth sides, and four corners which are rounded. The foldable lap tray includes an elongated spring material in the form of a loop attached to the periphery of the flexible web and adapted to fold into a smaller multi-looped folded configuration upon twisting the spring material out of the plane of the web. In the opened configuration, the first and third sides of the foldable tray are generally parallel or are curved in a convex manner outwardly with respect to each other, the second side extends between the first and third sides, and the fourth side extends between the first and third sides and curves in a concave manner inwardly toward the second side. In a preferred embodiment, the tray has at least one pocket attached to the tray.

It should be understood that both the foregoing general description and the following detailed description are exemplary only and are not restrictive of the invention as claimed. The accompanying drawings, which are incorporated in and constitute a part of the specification, illustrate various embodiments of the invention and, together with the description, serve to explain the principles of the invention.

DETAILED DESCRIPTION OF THE INVENTION

Figure 1:
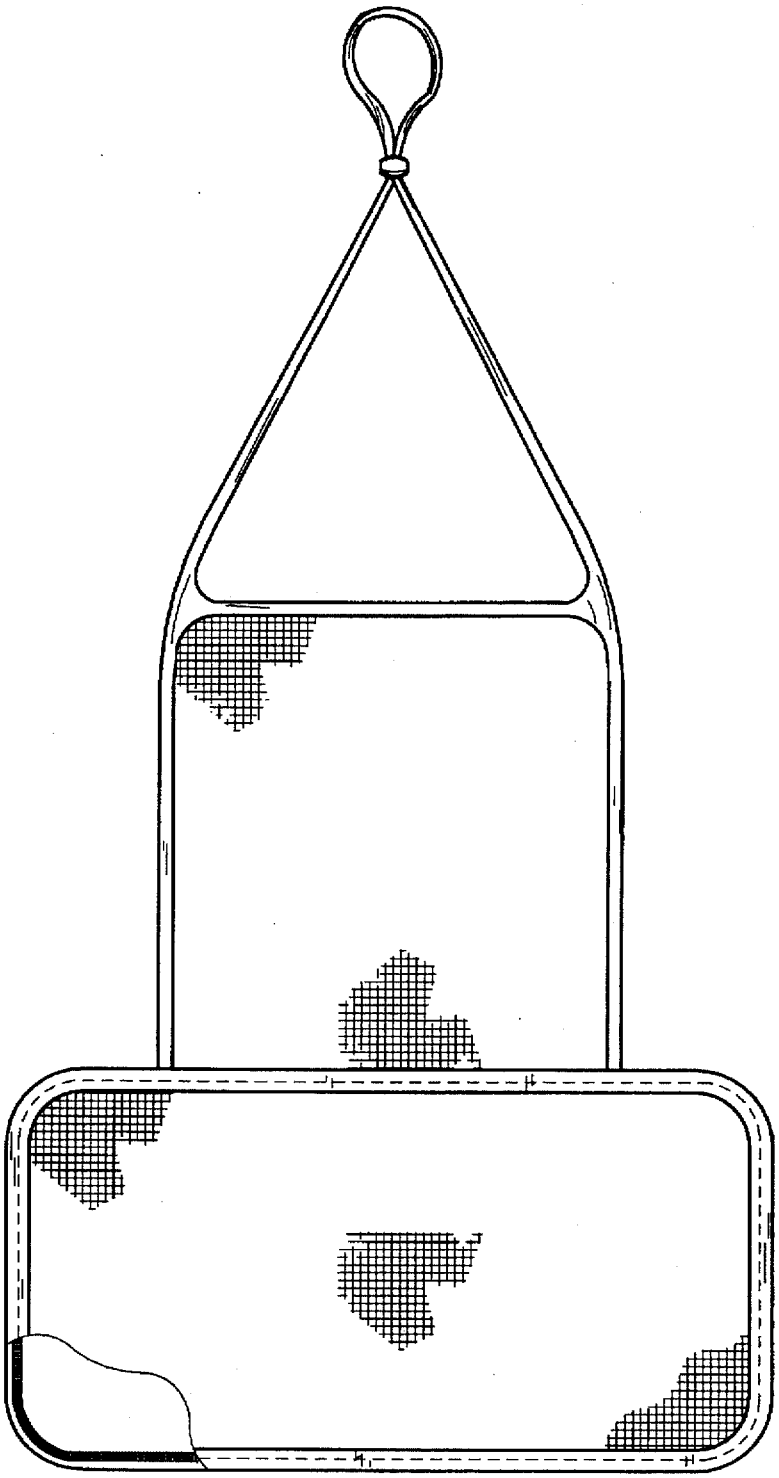
FIG. 1 is a plan view of an embodiment of the collapsible tray with a bib attached and a circular strap having a slidable closure element.

Referring to the Figures, the reversibly collapsible tray with attached bib (FIG. 1, 2 and 4A) and tray (FIG. 3) of the present invention includes a spring loop 10 as a peripheral support for a web 11 of flexible material which can be either woven or non-woven. Referring to FIG. 1, a foldable lap tray 12 with an attached bib 13 of the present invention includes a web 11 of flexible material that is attached to a loop of spring material 10 which forms the periphery 14 of the tray. The spring can be held in place either by having it inside a fold of the flexible material forming the web 11 or by having it attached to the web by a fabric tape or bias tape 15 that encircles the spring 10.

When in the extended or open position (FIG. 1–4A), the spring loop 10 exerts pressure on the web 11 holding it taut to form a relatively flat lap tray 12. The shape of the tray is determined by the shape of the web 11 with the spring material 10 conforming to the web shape when it exerts outward pressure. The shape can be substantially rectangular and usually has rounded corners (FIG. 1).

Figure 2:
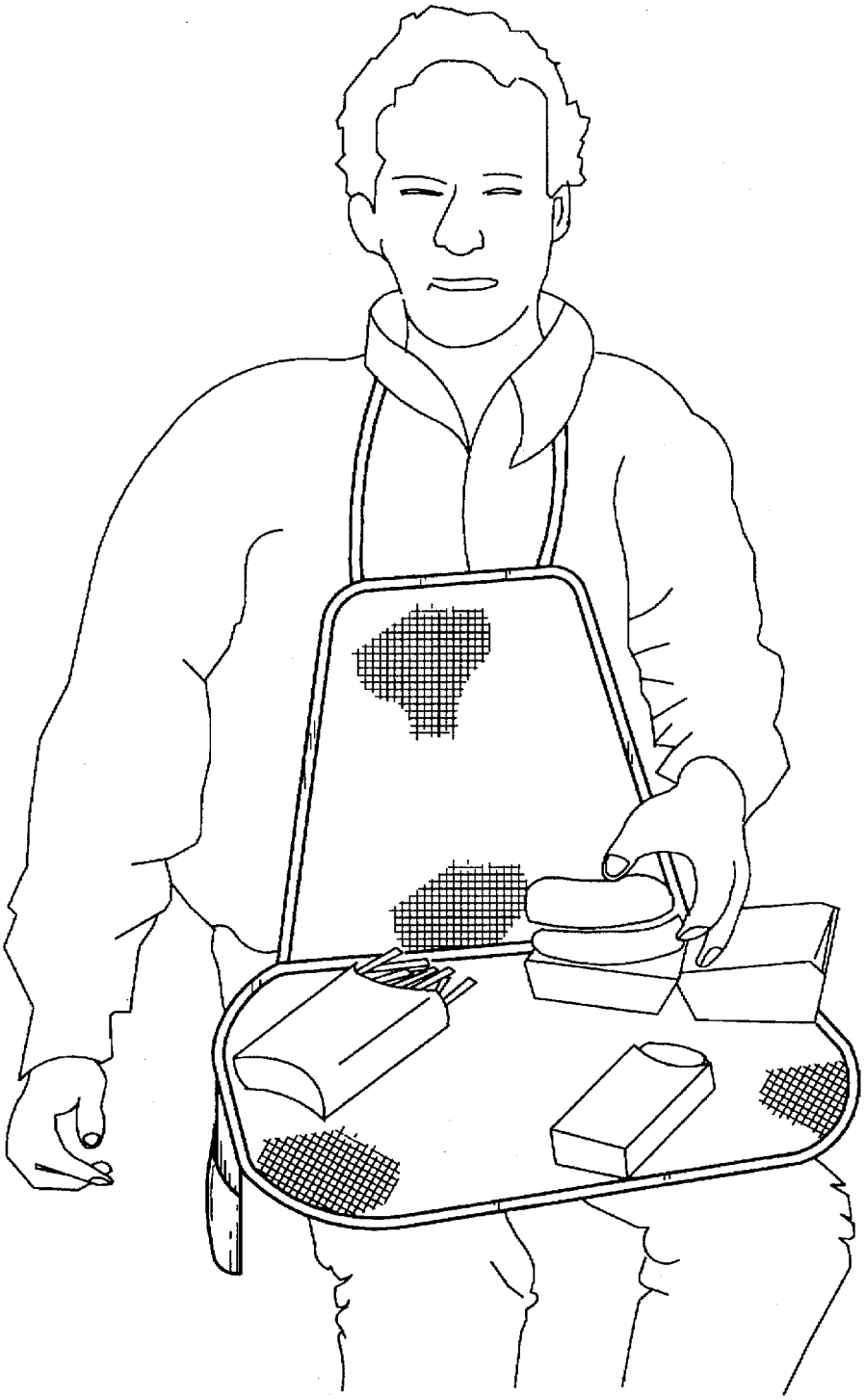
FIG. 2 is a prospective view of the collapsible tray with an attached bib covering the lap and front of a wearer, with a pocket attached to the side of the tray.
Figure 4A:
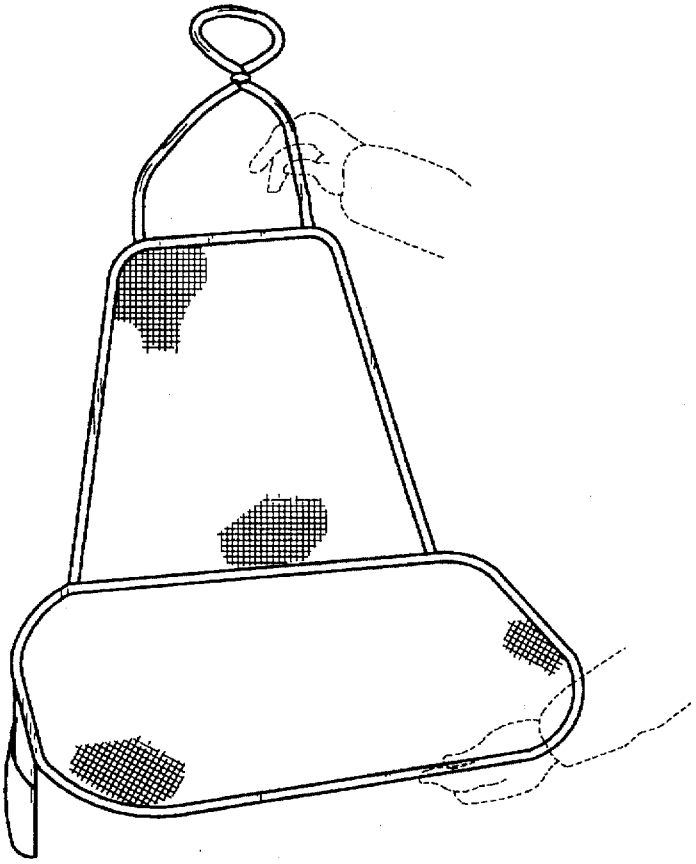
FIGS. 4(A) through 4(D) illustrate how the tray with attached bib is collapsed when the edge of the tray is twisted, resulting in a folded form that has a smaller configuration of joined loop members.
Figure 4B:
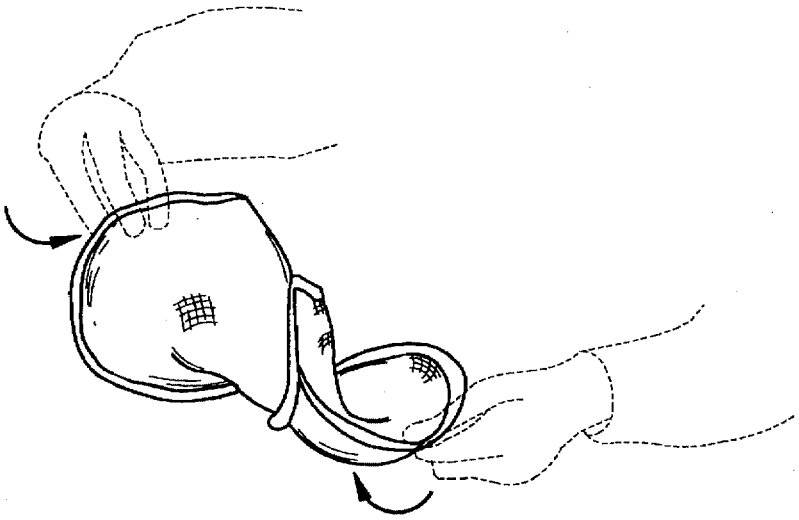
Figure 4C:
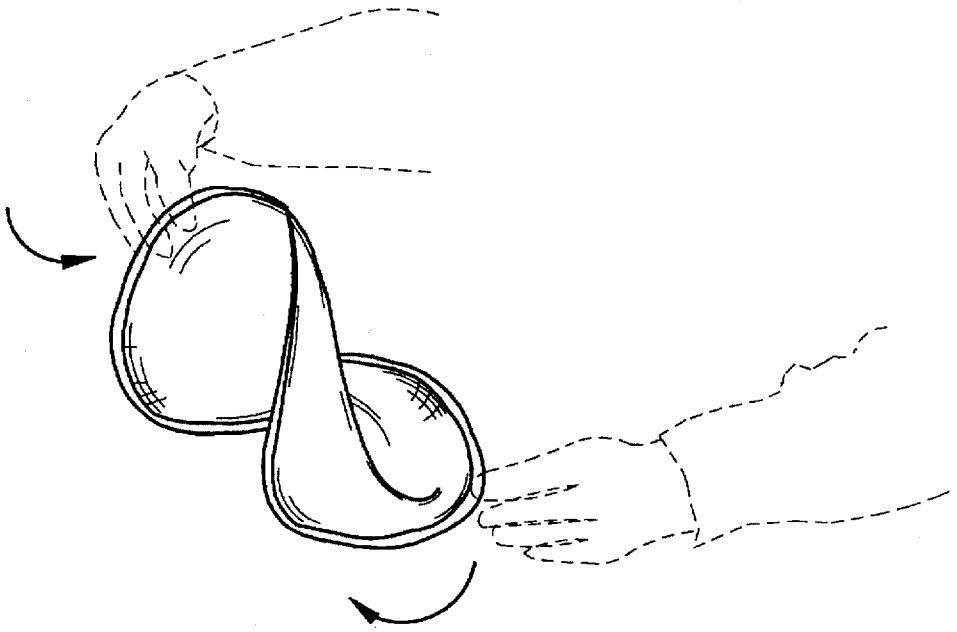
Figure 4D:
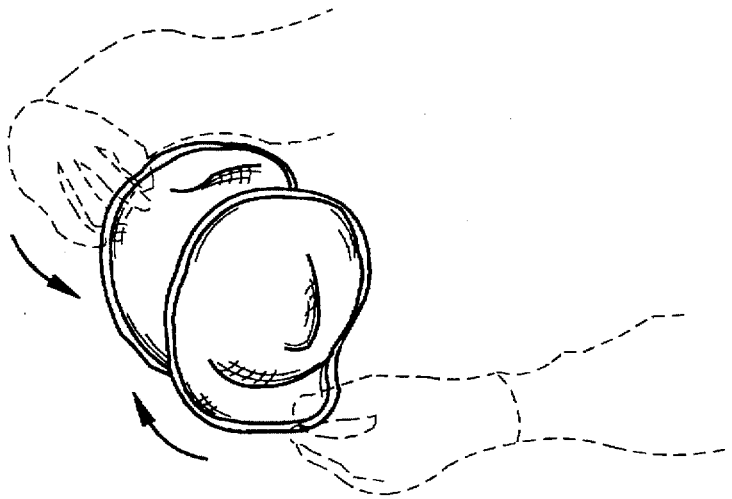

As shown in FIG. 1, FIG. 2 and FIG. 4A, the tray may have an attached bib 13 that is also made of a flexible web material 11. A circular strap 16 of fabric, fabric tape or other flexible material may form a neck opening which is adjustable in size by sliding a closure element 17 along the strap to open or close the neck opening. The slidable closure element 17, such as a bead, is held in place by friction. Other anticipated means of attachment of the bib to the wearer's neck include ties, loops, buttons, hooks, clasps, snaps, buckles, adhesives, hook-and-loop material or a circular opening in the bib's upper portion so that the wearer merely has to slip it over the head. The flexible bib 13 can be folded into the collapsible tray 12 simply by draping it over the tray portion (FIG. 4A) before twisting the spring (FIG. 4B and 4C) out of the plane of the extended spring loop to fold the tray (FIG. 4D).

Figure 3:
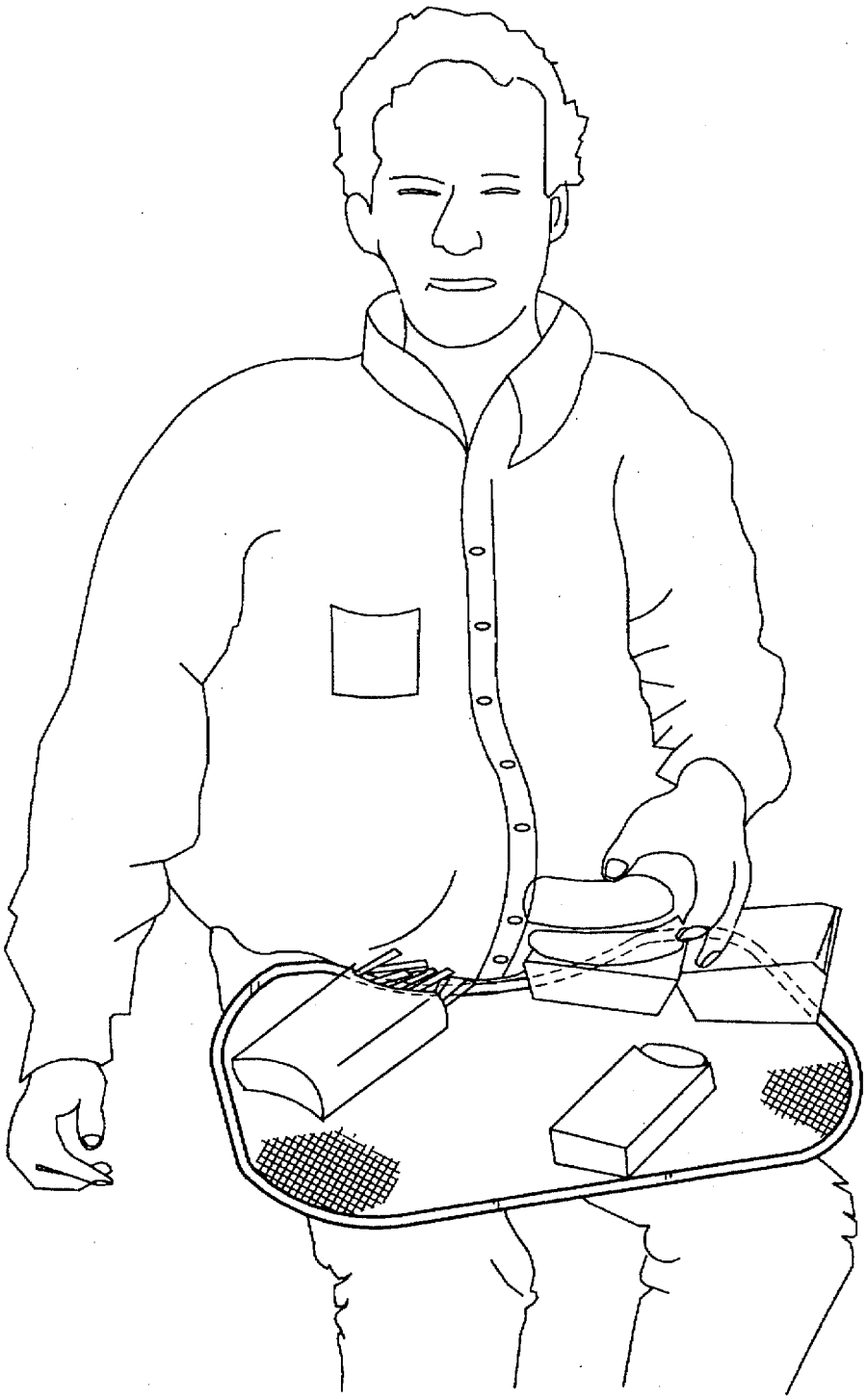
FIG. 3 is a prospective view of a collapsible tray with one concave side to accommodate the wearer's body contour when used to cover the wearer's lap.

Referring to FIG. 3, one embodiment of the collapsible tray 12 without a bib includes one side that is curved in a concave manner 18 toward the center of the tray so that the tray can accommodate the shape of the user's body, thus making it easier to balance the tray on the user's lap. It should be apparent to one skilled in that art that a tray 12 that has an attached bib 13 could similarly include such a concave curve in the side to which the bib is attached to allow the bib and tray to more easily accommodate the wearer's body.

Referring to FIG. 3, the foldable lap tray 12 includes a flexible web 11 of sufficient size to cover the lap of a wearer. When in an opened configuration, the web 11 defines a plane bounded by the first 19, second 20, third 21, and fourth 22 sides and four corners 23 that are rounded at the periphery of the web. The foldable lap tray also includes an elongated spring material in the form of a loop attached to the periphery 14 of the flexible web 11. This spring is adapted to fold into a smaller multi-looped folded configuration upon twisting the spring material out of the plane of the web. The opened configuration of the lap tray 12 has the first 19 and third 21 sides are generally parallel or are curved in a convex manner outwardly with respect to each other, the second side 20 extends between the first and third sides, and the fourth side 22 extends between the first and third sides. The fourth side curves in a concave manner 18 inwardly toward the second side. This concave fourth side allows the tray to fit more easily on the wearer's lap by accommodating the wearer's body.

Referring to FIG. 4, the tray 12 with attached bib 13 is easily collapsible by draping the bib over the tray (FIG. 4A) and then twisting (FIG. 4B and 4C) the peripheral edges 14 of the tray out of the plane of the spring loop causing the single loop to collapse into a series of smaller loops (FIG. 4D) with the attached flexible web 11 folding onto itself in the process. The tray can be opened from its folded configuration by twisting the multi-looped configuration (FIG. 4D) in the opposite direction as that used to fold the tray. The spring material 10 will expand into its extended form (FIG. 4A), thus reforming the tray by pulling the web material 11 taut.

A variety of materials are appropriate for the spring including metals, polymers or composite materials, such as fiberglass or graphite. All that is needed is that the spring material 10 be capable of reversibly forming the supporting loop at the periphery 14 of the tray. One preferred shape for the spring material is one in which the spring cross section has a major dimension and a minor dimension, where the major dimension is generally orthogonal to the plane of the web in the tray.

The tray can include one or more flexible pockets 24 attached to the tray 12. Such pockets are useful for holding food containers, small toys, drawing materials or the like but would not serve primarily to catch spills. Being flexible, the pockets can easily fold into the closed configuration of the tray (FIG. 4D).

The surface of the tray may include modifications that give it added useful features. For example, the web 11 of the tray 12 may include indicia or colors associated with a group or organization and the tray could then serve as a sign for that organization. For example, in a stadium, fans could display the colors or logo of their favored team by holding the trays aloft. By imprinting indicia on the tray, the tray can be useful for entertaining children by providing a playing surface. For example, a scene including a roadway could be imprinted on the tray and a child could play with a small toy car by running it along the imprinted roadway. Other indicia could be incorporated onto the surface of the tray to enhance the entertainment value. For example, a loop attached to the web could represent a bridge over the imprinted roadway.

The collapsible tray and bib-tray of the present invention are useful for covering a wearer's lap to prevent food from spilling onto the wearer's lap or for providing a surface on which the wearer can place objects. This can be especially useful when one is eating in a car or for providing a surface for a child to play when traveling in a car or other means of transportation. The bib-tray includes a bib to hold the tray in place on the wearer and provide additional protection from spilled food or liquids. By including colors and other imprinted indicia on the tray, it can providing a playing surface or may be used as a sign, for example, at sporting events. The tray is particularly convenient because it can be readily folded into a smaller configuration for storage and carrying. Thus it can be taken along to events and easily stored when not in use. When needed, the collapsed tray may be twisted into its open configuration for use.

The relevant portions of all the patents cited herein are incorporated by reference.

Although the present invention has been described in the context of particular examples and preferred embodiments, it will be understood that the invention is not limited to such embodiments. Instead, the scope of the present invention shall be measured by the claims that follow.

It should be apparent that various other materials may be substituted in the examples to produce similar collapsible trays. Accordingly, the invention may be embodied in other specific forms without departing from it in spirit. All modifications which come within the meaning and range of the lawful equivalency of the claims are to be embraced within their scope.

I claim:

1. A foldable lap tray, comprising:

a flexible web of sufficient size to cover the lap of a wearer, said web defining a plane when in an opened configuration;

elongated spring material in the form of a loop attached to a periphery of the flexible web and adapted to fold into a smaller multi-looped folded configuration upon twisting the spring material out of the plane of the web; and a foldable bib connected to the flexible web and including a means to attach the bib around the neck of a wearer.

2. The lap tray of claim 1, wherein the spring material is a flattened material having in cross section a major dimension and a minor dimension, wherein the major dimension of the spring material is generally orthogonal to the plane of the web.

3. The lap tray of claim 1, wherein the spring applies outward tension around the entire periphery of the web to hold the web in a flat open configuration.

4. The lap tray of claim 1, wherein the shape of the web defines the opened configuration of the spring.

5. The lap tray of claim 1, wherein a fabric tape encircles the spring and attaches the spring to the web.

6. The lap tray of claim 1, wherein the web is fabric.

7. The lap tray of claim 6, wherein the fabric is woven.

8. The lap tray of claim 6, wherein the fabric is nonwoven.

9. The lap tray of claim 6, wherein the fabric is liquid repellant.

10. The lap tray of claim 1, wherein said means to attach the bib around the neck of a wearer comprises ties.

11. The lap tray of claim 1, wherein said means to attach the bib around the neck of a wearer comprises a circular strap defining an opening through which the neck is inserted.

12. The lap tray of claim 11, further comprising a slidable closure element on the circular strap to adjust the size of the opening defined by the circular strap by adjusting the position of the slidable closure element on the circular strap.

13. The lap tray of claim 1, wherein the spring is metal.

14. The lap tray of claim 1, wherein the spring is a polymer material.

15. The lap tray of claim 1, wherein the spring is a spring is a composite material.

16. The lap tray of claim 1, wherein the tray is substantially rectangular.

17. The lap tray of claim 1, wherein the tray has at least one side that extends in a concave manner inward toward the center of the tray to allow the tray to accommodate the contour of the wearer's body.

18. The lap tray of claim 1, wherein the tray has at least one pocket attached to the tray.

19. The lap tray of claim 1, wherein the tray includes indicia on at least one surface of the web.

20. A foldable lap tray, comprising:

a flexible web of sufficient size to cover the lap of a wearer, said web defining a plane when in an opened configuration, said web having at its periphery first, second, third, and fourth sides and four corners;

elongated spring material in the form of a closed loop attached to the periphery of the flexible web and adapted to fold into a smaller multi-looped folded configuration upon twisting the spring material out of the plane of the web;

wherein in the opened configuration the first and third sides are generally parallel or are curved in a convex manner outwardly with respect to each other, the second side extends between the first and third sides, and the fourth side extends between the first and third sides and curves in a concave manner inwardly toward the second side; and the corners are rounded.

21. The lap tray of claim 20, wherein the tray has at least one flexible pocket attached to a side of the tray.

* * * * *